US006193115B1

(12) United States Patent
Das

(10) Patent No.: US 6,193,115 B1
(45) Date of Patent: Feb. 27, 2001

(54) INSULATED AND EASY TO PUMP REUSABLE MIST SPRAYER

(76) Inventor: Ajit Kumar Das, 11561 Highland La., Santa Ana, CA (US) 92705

( * ) Notice: Subject to any disclaimer, the term of this patent is extended or adjusted under 35 U.S.C. 154(b) by 0 days.

(21) Appl. No.: 09/369,601

(22) Filed: Aug. 6, 1999

(51) Int. Cl.[7] ..... B65D 83/00
(52) U.S. Cl. ..... 222/401; 239/337
(58) Field of Search ..... 239/337, 368, 239/369, 372, 355, 356, 360, 340, 428.5, 434; 141/3, 20; 222/401; 220/592.27, 62.18

(56) References Cited

U.S. PATENT DOCUMENTS

| | | | | |
|---|---|---|---|---|
| 3,998,361 | * | 12/1976 | Arena | 222/401 |
| 4,077,442 | | 3/1978 | Olofsson . | |
| 4,341,330 | * | 7/1982 | Mascia et al. | 222/401 |
| 4,399,919 | * | 8/1983 | Posnansky et al. | 220/592.27 |
| 4,492,320 | * | 1/1985 | Tada | 222/401 |
| 4,850,517 | | 7/1989 | Ter Stege . | |
| 5,131,569 | | 7/1992 | Hodgson . | |
| 5,209,379 | | 5/1993 | Dahlin . | |
| 5,265,775 | | 11/1993 | Sinclair . | |
| 5,267,674 | | 12/1993 | von Schuckmann . | |
| 5,323,935 | | 6/1994 | Gosslin . | |
| 5,337,929 | | 8/1994 | van der Heijden . | |
| 5,429,279 | | 7/1995 | van der Heijden . | |
| 5,749,502 | * | 5/1998 | Hinds | 222/401 |

* cited by examiner

*Primary Examiner*—Andres Kashnikow
*Assistant Examiner*—Lisa Ann Douglas
(74) *Attorney, Agent, or Firm*—Oppenheimer, Wolff & Donnelly LLP; Christopher Darrow; Sung Oh

(57) ABSTRACT

An exemplary reusable mist sprayer according to the present invention includes a container with an opening which has double walls that is vacuum sealed between the walls to provide insulation from the atmosphere. The exemplary sprayer also includes a plunger to pump atmospheric air into the container. The plunger respectively has a hole and hollow opening at the opposing ends, the hole provides a path for atmospheric air to enter the interior space of the plunger. Enclosing the opening of the container is a removable dispenser mechanism having a protruding end adapted to receive the hollow opening of the plunger, and a flange adapted to removably seal the opening of the container. A one-way valve is associated with the protruding end, which only opens to allow the air within the interior space of the plunger to enter the container as the plunger is being pressed relative to the protruding end. A plug is associated with the hole such that the plug engages with the hole as the plunger is being pressed relative to the protruding end, and the plug disengages with the hole as the plunger is being pulled relative to the protruding end. As such, air within the plunger is trapped to be injected into the container through the one-way valve when the plunger is pressed relative to the protruding end, but when the plunger is pulled relative to the protruding end the hole is open to relieve the vacuum within the interior space of the plunger to make it easier for a user to pull the plunger.

17 Claims, 4 Drawing Sheets

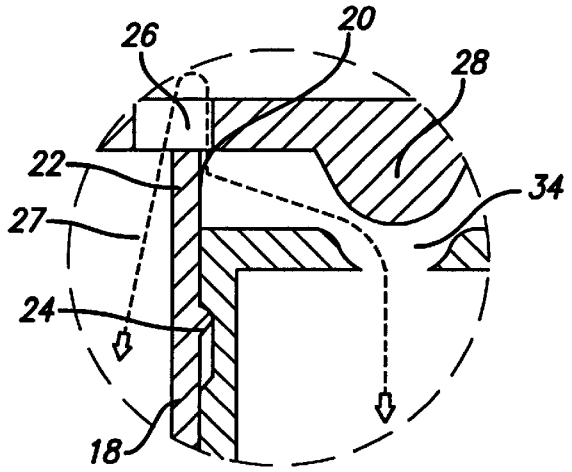
FIG. 1b
FIG. 1a
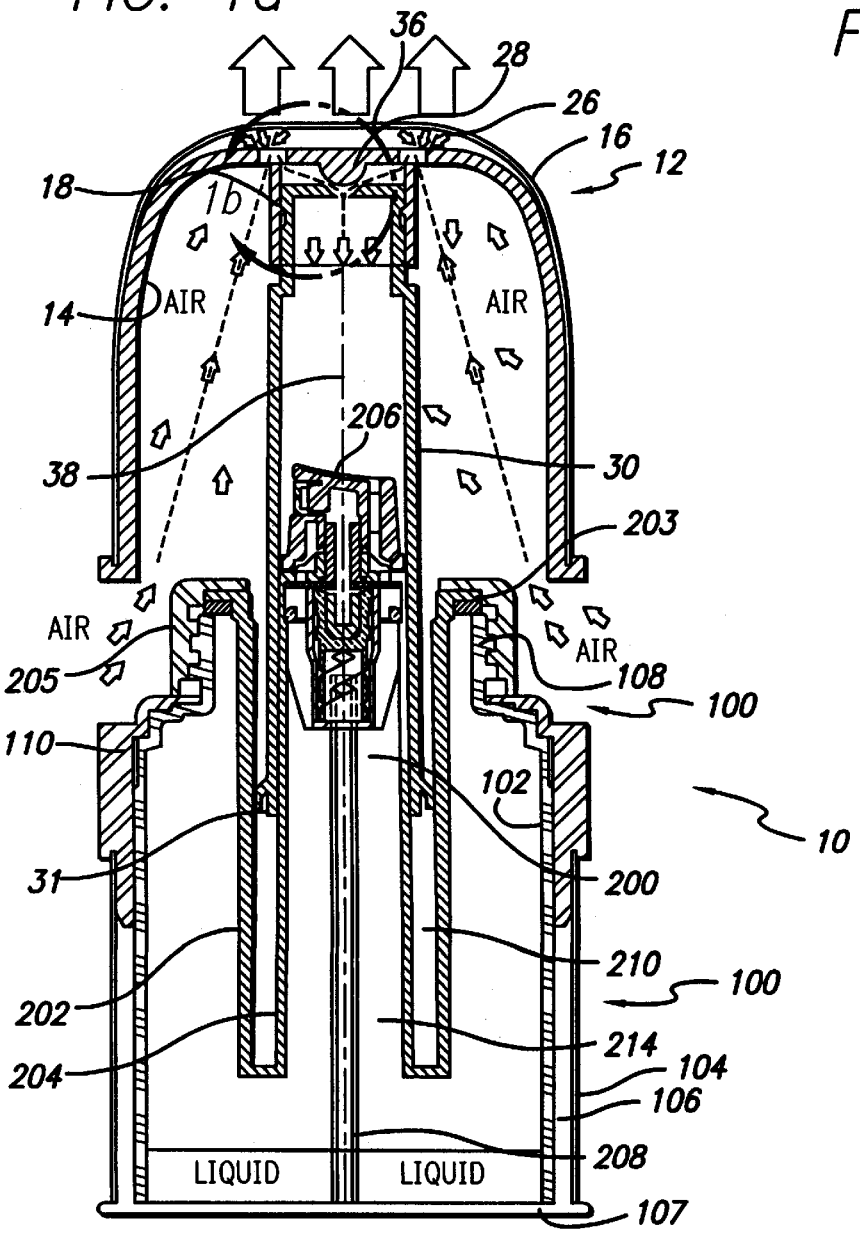

FIG. 2a
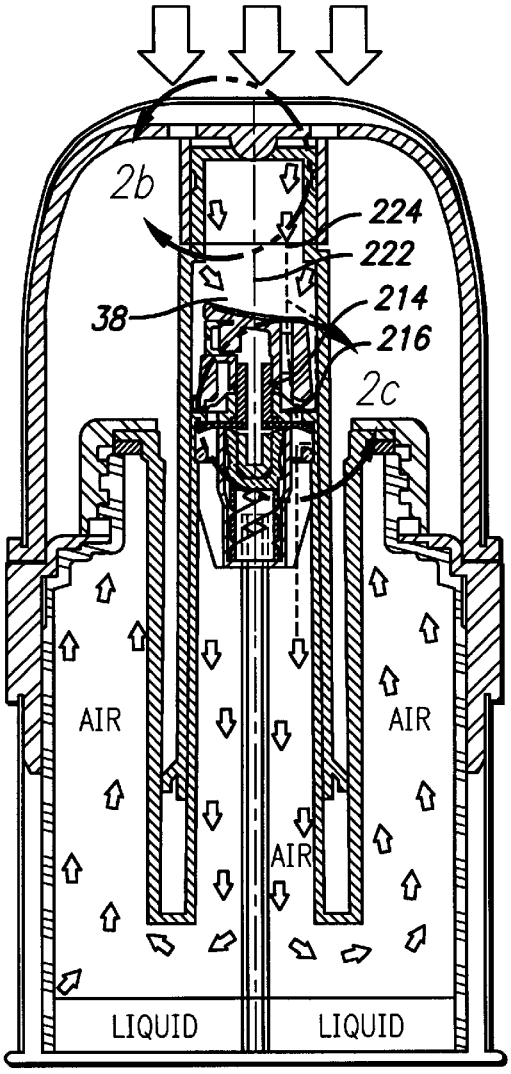
FIG. 2b
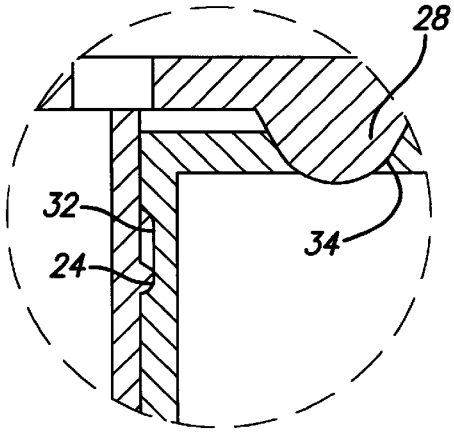
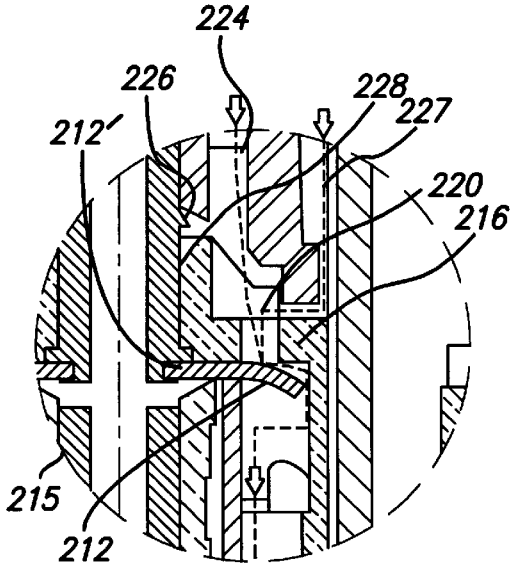
FIG. 2c

FIG. 3a
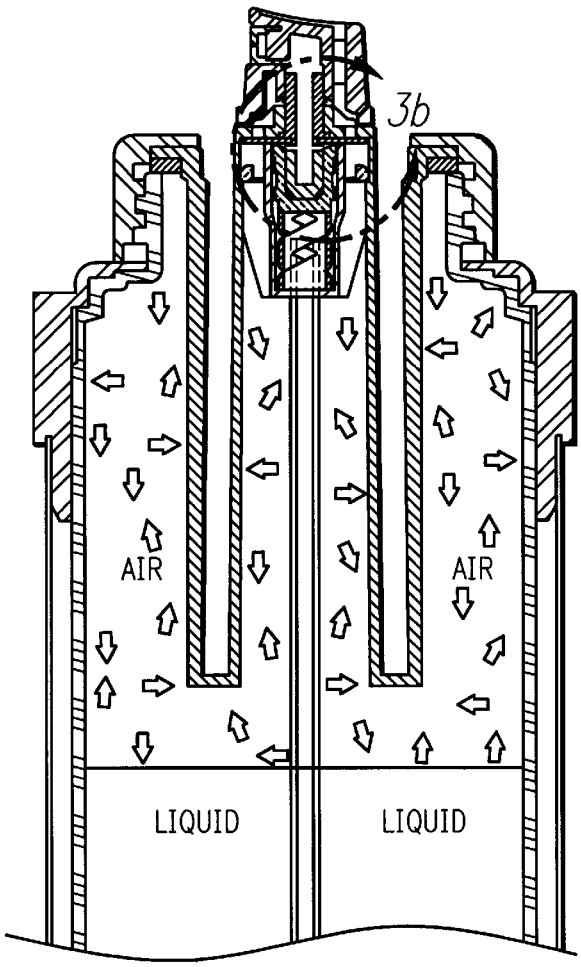
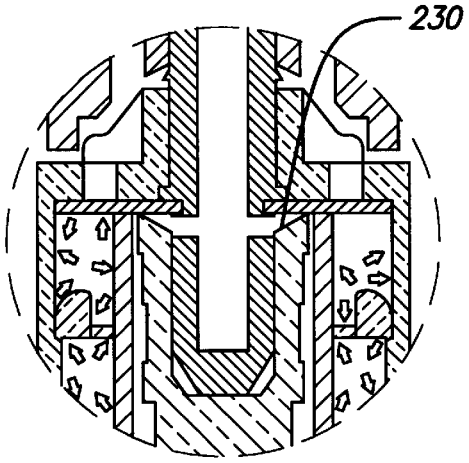
FIG. 3b

FIG. 4a
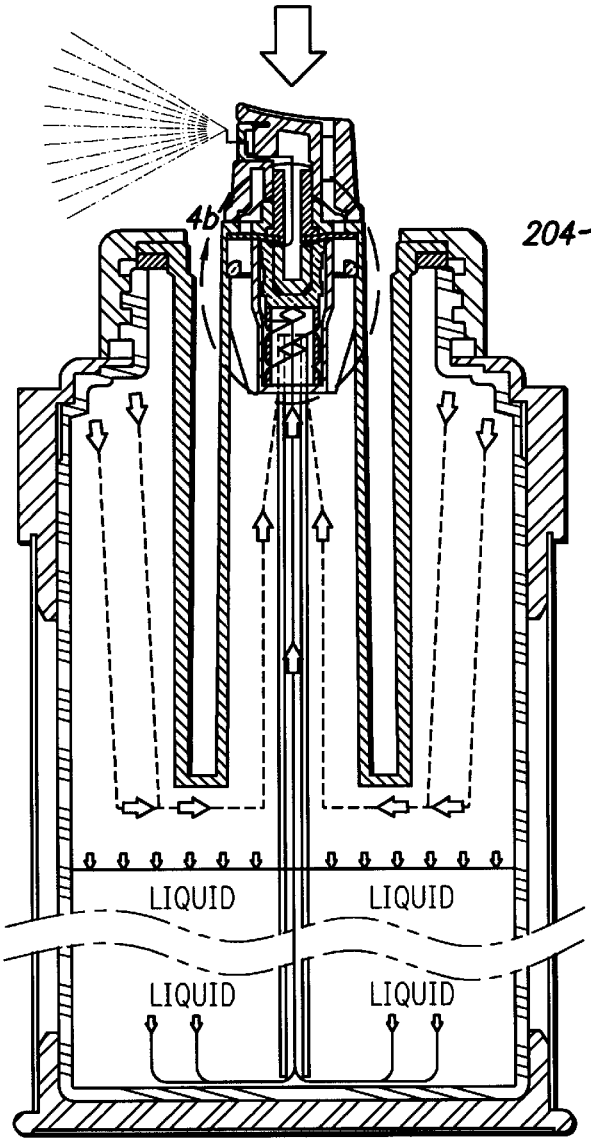
FIG. 4b
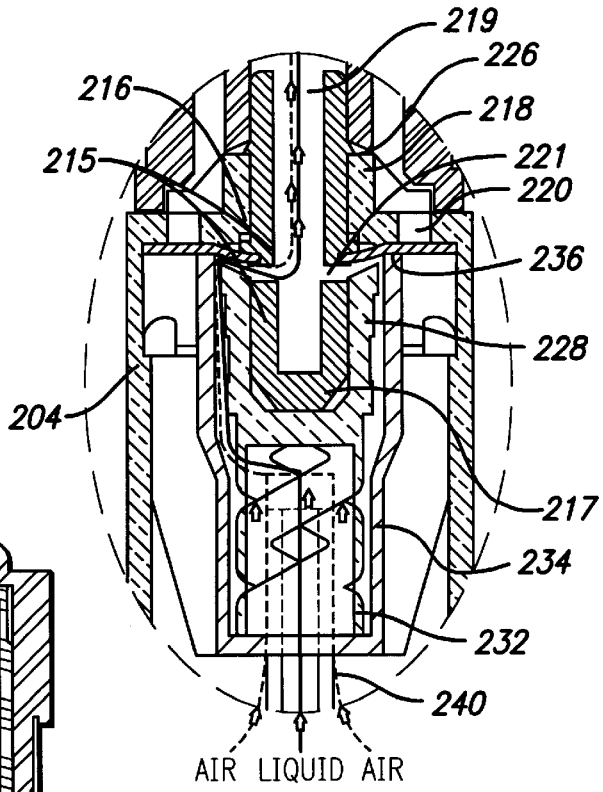
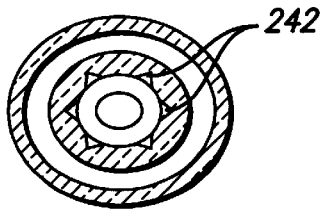
FIG. 4c

INSULATED AND EASY TO PUMP REUSABLE MIST SPRAYER

BACKGROUND OF THE INVENTION

1. Field of Invention

This invention relates generally to a sprayer and, more particularly, to an improved refillable mist sprayer.

2. Description of the Related Art

Mist sprayers generally known as "user pressurized dispensers" are used for spraying liquids in atomized form, i.e., in a mist form. Such sprayers are designed to store and spray liquids that stay in the liquid form over a wide range of temperatures, i.e., not changing its form from liquid to solid, such as water, perfume, deodorants, oil, and vinegar. However, these sprayers are not well adapted for use with liquids that are sensitive to temperature changes. That is, sprayers presently know as "user pressurized dispensers" are not well adapted for use with melted butter for example, because these sprayers are not well insulated. Consequently, after a short period of time the melted butter would cool and solidify. Obviously, the solidified butter cannot be sprayed out of the sprayer. As such, the unused butter within the sprayer has to be either reheated or cleaned out of the sprayer.

However, with today's health conscious public, a sprayer that is well adapted to spraying even melted butter over a long period of time would be advantageous for low fat cooking. That is, by precisely controlling the amount of butter being applied during cooking or over their food, people can enjoy the taste of butter without consuming a lot of fat. For example, by evenly spraying melted butter over a bag of popcorn, people can enjoy the rich taste of butter without using a lot of butter.

Yet another shortfall with today's mist sprayers is their construction. For example, U.S. Pat. No. 4,077,442, issued to Olofsson, discloses common features in these sprayers. That is, a container with a head provided with a manually operable valve mechanism and a nozzle in communication with the valve mechanism and arranged upon opening of the valve mechanism, to discharge the liquid contained in the container under excess pressure in the form of a spray. A cap is also provided for enclosing the head of the container, and when the cap is forced down, the air inside the cap is pressed and pressure increases, which opens a passage and allows the excess pressure to propagate down into the container. Upon elimination of such excess pressure, the passage again closes. One of the draw backs with the above construction is that as the air propagates into the container, a vacuum is formed inside the cap, and as the cap is withdrawn the vacuum resists the pulling force on the cap. Therefore, cumbersome pumping forces have to be applied to the cap to pump air into the container.

Thus, there still is a need for a mist sprayer that insulates the liquid stored in the sprayer, and makes it easier for a user to pump air into the container.

OBJECT AND SUMMARY OF THE INVENTION

One of the objects of the present invention is to provide a reusable mist sprayer that can substantially maintain initial temperature of the liquid that has been poured into the sprayer container. Yet another objective is to make the sprayer user friendly by making it easier to pump atmospheric air into the container.

In accordance with one aspect of the present invention, these and other objectives are accomplished by providing a container having an interior well and an exterior case with a substantially vacuum sealed gap therebetween with an opening; a cap with an interior surface; a plug extending from the interior surface of the cap; a plunger movably coupled to the interior surface of the cap, the plunger having a hole aligned with the plug and a hollow opening at the opposing end of the hole, wherein the hole provides a path for atmospheric air to enter the interior space of the plunger; a removable dispenser mechanism having a protruding end adapted to receive the hollow opening of the plunger, and a flange adapted to removably seal the opening of the container; wherein the plug engages with the hole of the plunger as the cap is being pressed relative to the container, and the plug disengages with the hole as the cap is being pulled relative to the container; a one-way valve associated with the protruding end, wherein the one-way valve only opens to allow the air within the interior space of the plunger to enter the container as the plunger is being pressed relative to the container; a throat movably coupled through the protruding end of the dispenser mechanism between a first and second positions, the throat having a port to allow a combination of air and liquid within the container to flow through the port, wherein the port is closed in the first position and the port is open in the second position; a bias member coupled to the throat, wherein the bias member is predisposed to place the throat in the first position; and a nozzle coupled to the throat, wherein upon application of downward force on the nozzle the throat moves into the second position to allow the combination of air and liquid within the container to flow through the port and flow through the nozzle.

With today's health conscious society, there are numerous applications for the exemplary sprayer. For example, the sprayer may be used for spraying melted butter for low fat cooking. That is, by precisely controlling the amount of butter being applied during cooking or over their food, people can enjoy the taste of butter without consuming a lot of fat. By evenly spraying melted butter over a container of popcorn, people can enjoy the rich taste of butter while using a minimal amount of butter. Moreover, the melted butter inside the container remains melted for a longer period of time. This way, a user can spray the melted butter for longer period of times. Yet another application for the sprayer is to spray a mist of cold water on hot summer days. For example, a golfer can put cold water into the sprayer and the sprayer will keep the cold water cool for a longer period of time so that a user can have a refreshing cool mist spray later in the day.

The above described and many other features and attendant advantages of the present invention will become apparent from a consideration of the following detailed description when considered in conjunction with the accompanying drawings.

BRIEF DESCRIPTION OF THE DRAWINGS

A detailed description of the preferred embodiment of the invention will be made with reference to the accompanying drawings.

FIG. 1*a* is a cross-sectional view of an exemplary sprayer with a cap being pulled;

FIG. 1*b* is an enlarged cross-sectional view of a circular area 1*b* in FIG. 1*a*, showing an exemplary air path for outside air to enter the interior of a cap;

FIG. 2*a* is a cross-sectional view of an exemplary sprayer with a cap being pressed;

FIG. 2*b* is an enlarged cross-sectional view of a circular area 2*b* in FIG. 2*a*, showing an exemplary air path being closed to trap air inside a cap as the cap is being pressed;

FIG. 2*c* is an enlarged cross-sectional view of a circular area 2*c* in FIG. 2*a*, showing a valve being opened to allow the air inside a cap to propagate down into the container;

FIG. 3*a* is a cross-sectional view of an exemplary sprayer with a valve closed to trap the air within a container;

FIG. 3*b* is an enlarged cross-sectional view of a circular area 3*b* in FIG. 3*a*, showing a valve in a closed position;

FIG. 4*a* is a cross-sectional view of an exemplary sprayer with a nozzle in a pressed position releasing a mist of liquid;

FIG. 4*b* is an enlarged cross-sectional view of a circular area 4*b* in FIG. 4*a*, showing a valve in an open position as the nozzle is pressed; and FIG. 4*c* is a cross-sectional view along A—A in FIG. 4*b*, showing exemplary inlet paths for liquid and air.

DETAILED DESCRIPTION OF THE PREFERRED EMBODIMENTS

Disclosed herein is a detailed description of a best presently known modes of carrying out the invention. This description is not to be taken in a limiting sense, but is made merely for the purpose of illustrating the general principles of the invention. The section titles and overall organization of the present detailed description are for the purpose of convenience only and are not intended to limit the present invention.

As illustrated by way of example in FIGS. 1*a* and 1*b*, an exemplary sprayer 10 is shown with its respective elements in a first position, as discussed below. The sprayer 10 includes a cap 12 which is associated with a container 100 so that the cap 12 may be pressed and depressed relative to the container 100. The cap 12 preferably has an interior shell 14 enclosed by an exterior shell 16. Protruding from the interior shell 14 is a bore 18 having an interior side 20 and exterior side 22, with a notch 24 within the interior side 20 of the bore 18. Preferably, as most clearly shown in FIG. 1*b*, an air path 26 is formed to allow air to freely flow between the exterior side 22 and the interior side 20 of the bore 18, as indicated by way of example in the dotted-arrow line . Preferably, the air path 26 is formed by at least one opening, such as a circular opening 27, on the interior shell 14, with a circumference of the opening extending past the interior and exterior sides 20, 22, respectively. Furthermore, as shown in FIG. 1*a*, a gap 36 may be formed between the interior and exterior shells 14, 16, respectively, near the upper region of the cap 12 so that air may freely flow between a second opening 26' on the interior shell 14, if the second opening is provided.

Within the interior side 20 is a plug 28 on the surface of the interior shell 14. Preferably, the bore 18 is releasably coupled to a plunger 30 via an elongated recess 32 which engages with the notch 24 of the bore 18 to provide relative axial movement between the plunger 30 and bore 18. Still further, the plunger 30 has an opening 34 axially aligned with the plug 28. The opening 34 allows the atmospheric air to freely enter the plunger space 38 within the plunger 30. As such, FIGS. 1*a* and 1*b* illustrate the exemplary sprayer 10 in the first position, which show the cap 12 being pulled causing the opening 34 to be open to allow the atmospheric air to freely enter the plunger space 38.

Alternatively, a hole may be provided through each of the side walls of the bore 18 and plunger 30, such that the holes on the bore and plunger are aligned in the first position. As such, when the sprayer is in the first position, atmospheric air may enter the plunger space 38 through the aligned holes. However, when the plunger moves relative to the bore, the holes become misaligned and atmospheric air is block from entering the plunger space 38.

With regard to the container 100, the container 100 preferably includes an inner well 102, and enclosing the well 102 is an exterior case 104 with a sealed gap 106 therebetween. At the bottom of the container 100 is a base 107 to couple the interior well 102 and exterior case 104 together. At the top of the container 100 is the inner well 102 forming a tapered threaded opening 108, which is coupled to the top end of the exterior case 104 by a collar 110. Preferably, the collar 110 and base 107 form an air tight seal between the well 102 and case 104 around the top and bottom of the container 100, respectively. Preferably, the sealed gap 106 is substantially vacuumed to minimize heat or thermal energy from being transferred between the inner well 102 and exterior case 104. This way, hot or cold liquids within the inner well 102 will substantially maintain its initial temperature. Additionally, with the vacuum gap between the inner well 102 and case 104, the exterior surface of the case 104 is substantially insulated from the hot or cold liquid contained within the inner well 102, so that the sprayer can be comfortably handled. Moreover, even if cold liquids were held by the sprayer, there is less likely chance of condensation forming on the surface of the case 104 because the difference in temperature between the case 104 and atmosphere is minimized.

Enclosing the tapered threaded opening 108 is a dispenser mechanism 200 which includes a nozzle 206, a feeder tube 208, and a plunger channel 210 defined by an outer wall 202 and inner wall 204. The outer wall 202 terminates to form a flange 203 extending outwardly to flush against the tapered threaded opening 108. To secure the dispenser mechanism 200 to the interior well 102 is a screw top 205 fastened to the threaded opening 108, forming an air tight seal so that atmospheric air cannot enter the container space 214 between the outer wall 202 and inner well 102. The inner wall 204 is configured to be receptive to the plunger 30 so that the plunger 30 may slide up and down along the plunger channel 210. Preferably, a seal is formed between the inner wall 204 and the interior surfaces of the plunger 30 so that the air within the plunger 30 does not leak through the seal. In this embodiment, the outer and inner walls, 202, 204, respectively, run substantially parallel to one another so that a lip 31 of the plunger 30 slides along the both walls, 202, 204. Alternatively, the inner wall 204 may be in a slight inclined angle so that the lip 31 does not slide along the inner wall 204. This way, air does not get trapped at the bottom of the plunger channel to resist the plunger 30 from being pushed in, and a vacuum is not created to resist the plunger 30 from being pulled out.

As shown most clearly in FIG. 1*b*, with the above exemplary construction, as the cap 12 is pulled out relative to the container 100, the plug 28 disengages with the opening 34, which allows air outside of the exterior side 22 to freely flow into the interior side 20, then into the plunger space 38 within the plunger 30, via the air path 26 and the opening 34. The air entering the plunger space 38 relieves the vacuum that was created after the previous down stroke of the plunger 30. This way, no vacuum exists in the plunger space 38 to resist the plunger 30 from being pulled out. Accordingly, with the above exemplary sprayer 10 construction, a user can hold the cap to smoothly pump the plunger to inject air into the container space.

FIGS. 2*a*–2*c* show the exemplary sprayer 10 in a second position as the cap is being pressed relative to the container 200. Here, as the cap 12 is being pressed, the notch 24 moves axially along the elongated recess 32 of the plunger, causing the plug 28 to engage with the opening 34 to seal the opening 34, as most clearly shown in FIG. 2*b*. As such, the air inside the plunger space 38 is trapped and the pressure increases as the volume inside the plunger space 38 decreases. The increased pressure opens a one-way valve 212 to allow the air inside the space 38 to enter the container space 214, as shown by way of example by the dotted line in FIG. 2*c*. The one-way valve 212 only allows the air to enter the container space, but does not allow the air inside the container space to flow through the valve, as most clearly shown in FIG. 3*b*. More details about the internal workings of the dispenser 200 are discussed below.

As illustrated by way of example in FIG. 4*b*, the inner wall 204 forms a protruding end 216 with a throat opening 218 and an inlet opening 220. The dispenser mechanism further includes a throat 215 with a closed end 217 and an open end 219. The throat extends from the container space 214 to the plunger space 38 through the throat opening 218, with the open end 219 protruding to the plunger space 38, and the closed end 217 protruding to the container space. The throat also has a port opening 221, where a combination of liquid and air may enter therethrough, as further explained below. The throat 215 is axially moveable within the throat opening 218, and is predisposed to be in the first position, as illustrated in FIG. 2*c*. Also, around the exterior surface of the throat is preferably a nipple 226 to stop the throat from being further inserted into the nozzle. Still further, downward axial movement of the throat relative to the throat opening is limited by the nipple 226, as shown most clearly in FIG. 4*b*. Preferably, the throat 215 has a rounded shape, along with the valve 212 that surrounds the throat. Furthermore, the sprayer 10 preferably has a substantially rounded shape, including the plunger, cup, housing, and protruding end.

With regard to the nozzle 206, it has a cavity opening 222 to receive the open end 219 of the throat but the penetration is limited by the nipple 226. The nozzle preferably has a first air path opening 224 on the top thereof, so that the air inside the plunger space 38 has a direct path to the inlet opening 220. Alternatively, a second air path 227 may be formed between the interior surfaces of the plunger and the nozzle, as shown most clearly in FIG. 2*c*. As such, as the cap 12 is being pressed, the pressure inside the plunger space 38 increases causing the one-way valve 212 to open, and allows the air to flow through the inlet opening 220. However, the one-way valve only allows the air to enter the container space 214, i.e., as the cap 12 is being pulled out, the valve closes to trap the air inside the container space, as shown most clearly shown in FIG. 3*b*. Accordingly, a user may pump the cap 12 repeatedly until a desired pressure is achieved within the container space.

As illustrated by way of example in FIGS. 4*a*–4*c*, once the desired pressure is achieved within the container space, a user may press the nozzle to spray a fine mist of the liquid inside the container space. More specifically, enclosing the closed end 217 of the throat 215 is a cup 228 with its lip 230 sealing around a gasket 212' (note that the gasket 212' is an inner extension of the valve 212), as most clearly shown in FIGS. 2*c* and 3*b*. Coupled to the base of the cup 228 is a biased member 232 with sufficient resistance to form an air tight seal between the lip 230 and the gasket 212', in the first position. Furthermore, enclosing the cup 228 and the biased member 232 is a housing 234 with its lip 236 sealing around the gasket 212'. A path is formed between the exterior side surfaces of the cup 228 and the interior side surfaces of the housing 234 to allow a combination of air and liquid to travel therethrough. As shown most clearly in FIG. 4*c*, at the bottom of the housing 234 is an opening 240 adapted to receive the feeder tube 208, and a plurality of smaller openings 242 to allow the air in the container space to flow through into the interior space of the housing 234. The feeder tube 208 has a sufficient length to reach the bottom of the container to the opening 240. Preferably, the biased member 232 is a coil member, such as a spring.

As the nozzle is pressed, the above exemplary dispenser 200 is in the second position, as shown most clearly in FIG. 4*b*. That is, in the second position, the downward force of the nozzle causes the nipple 226 to engage with the throat opening 218. As such, the downward axial movement of the throat overcomes the resistance of the biased member 232 and causes the cup 228 to also move down, thereby disengaging the lip 230 from the gasket 212'. As shown most clearly in FIG. 4*b*, the disengagement leaves an opening for the combination of the liquid and air to flow through the port opening 221 of the throat, then through the open end of the throat, and then finally to the nozzle, as indicated by way of example by the dotted-arrow line. When the nozzle is no longer pressed, the bias member 232 pushes on the cup to reseal the path between the lip 236 and the gasket 212' to prevent the combination of liquid and air from exiting the container space.

To use the exemplary sprayer 10, a user preferably fills the container space with the desired liquid up to about the bottom of the dispenser mechanism, i.e., the base where the outer and inner walls, 202 and 204 respectively, meet. This allows the rest of the container space to be filled with air, so that additional atmospheric air can be pumped into the container space. Then, the dispenser mechanism 200 is inserted into the container space and locked in by the screw top 205. Thereafter, the plunger 30, which is movably coupled to the cap, may be inserted into the plunger channel 210, and pumped up and down to inject atmospheric air into the container space, so that the pressure inside the container space is greater than the atmospheric pressure outside the container space. When the nozzle is pressed, the pressure inside the container pushes the liquid through the feeder tube 208 and into the housing 234. Also, air inside the container flows through the plurality of smaller openings 242 and into the housing 234, as shown most clearly in FIG. 4*b*. The combination of liquid and air inside the housing are then pushed through the gap between the gasket 212' and the lip 31, next through the port opening 221 of the throat, then through the open end of the throat, and then finally flowing through the nozzle as a fine mist spray of the liquid.

With regard to the material, the sprayer 10 may be made of variety of plastic materials, such as polyvinyl chloride (PVC), polyethylene, polypropylene, ethylene-vinyl acetate (EVA), and polyurethane, to just a name a few, or other materials that are know to one ordinarily skilled in the art. More preferably, the one-way valve 212 (or gasket 212') may be made of silicon. Still further, the exterior shell 16 of the cap 12 and the exterior case 104 are preferably made of stainless steel. Alternatively, the inner well 102 may be made of 18 gage stainless steel, and the exterior case 104 may be made of 8 gage stainless steel, which may be vacuum sealed together. Yet another alternative is to have both the inner well 102 and exterior case 104 made of transparent material so that a user can see how much of the liquid is left in the container space.

With today's health conscious society, there are numerous applications for the exemplary sprayer. For example, the sprayer may be used for spraying melted butter for low fat cooking. That is, by precisely controlling the amount of butter being applied during cooking or over their food, people can enjoy the taste of butter without consuming a lot of fat. For example, by evenly spraying melted butter over a container of popcorn, people can enjoy the rich taste of butter with a minimal amount of butter. Moreover, the melted butter inside the inner well 102 will substantially maintain its initial temperature because the vacuum gap substantially prevents the thermal energy from conducting through the inner well 102 and exterior case 104. In other words, with the present invention, the melted butter remains melted for a longer period of time, and does not solidify thus restricting the butter from being sprayed. This way, a user can precisely control the amount of melted butter being applied to their food, so that the user can enjoy the taste of butter with less fat and calories. Yet another application for the sprayer is to spray a mist of cold water on hot summer days. For example, a golfer can put cold water, along with ice, in the sprayer and the sprayer will keep the cold water cool for a longer period of time so that a user can have a refreshing cool mist spray later in the day.

Other spraying applications include: salad dressing, such as oils or vinegar, furniture polish, laundry detergent, perfume, and window cleaner, just to name a few. In essence, the present invention may be used for many applications where a mist of the liquid is preferred, or where it is desirable to substantially maintain the initial temperature of the liquid. Furthermore, the plunger is easily pumped because there is no vacuum to resist the pumping action. When all of the desired liquid is sprayed out of the sprayer, the container space may be refilled with the same liquid or different liquid for an another use.

In closing, it is noted that specific illustrative embodiments of the invention have been disclosed hereinabove. However, it is to be understood that the invention is not limited to these specific embodiments. Accordingly, the invention is not limited to the precise embodiments described in detail hereinabove. With respect to the claims, it is applicant's intention that the claims not be interpreted in accordance with the sixth paragraph of 35 U.S.C. § 112 unless the term "means" is used followed by a functional statement.

What is claimed is:

1. A reusable mist sprayer, comprising:

a container having an interior well and an exterior case with a substantially vacuum sealed gap therebetween with an opening;

a cap with an interior surface;

a plug extending from the interior surface of the cap;

a plunger movably coupled to the interior surface of the cap, the plunger having a hole aligned with the plug and a hollow opening at the opposing end of the hole, wherein the hole provides a path for atmospheric air to enter the interior space of the plunger;

a removable dispenser mechanism having a protruding end adapted to receive the hollow opening of the plunger, and a flange adapted to removably seal the opening of the container;

wherein the plug engages with the hole of the plunger as the cap is being pressed relative to the container, and the plug disengages with the hole as the cap is being pulled relative to the container;

a one-way valve associated with the protruding end, wherein the one-way valve only opens to allow the air within the interior space of the plunger to enter the container as the plunger is being pressed relative to the container;

a throat movably coupled through the protruding end of the dispenser mechanism between a first and second positions, the throat having a port to allow a combination of air and liquid within the container to flow through the port, wherein the port is closed in the first position and the port is open in the second position;

a bias member coupled to the throat, wherein the bias member is predisposed to place the throat in the first position; and a nozzle coupled to the throat, wherein upon application of downward force on the nozzle the throat moves into the second position to allow the combination of air and liquid within the container to flow through the port and flow through the nozzle.

2. The sprayer according to claim 1, including a cup movably associated with the throat within the container such that the movement of the cup corresponds to the movement of the throat between the first and second positions, wherein in the first position the cup forms a seal with the protruding end of the dispenser mechanism to close off the port, and in the second position the cup opens the seal with the protruding end to provide a path to the port.

3. The sprayer according to claim 2, including a housing enclosing the cup with a space between the cup and housing, wherein the path to the port includes the space to allow the combination of liquid and air within the container to flow through the port and flow through the nozzle.

4. The sprayer according to claim 3, including a tube coupled to the housing and extending into the container.

5. The sprayer according to claim 1, wherein the exterior case is made of stainless steel.

6. The sprayer according to claim 1, wherein the cap has an exterior surface made of stainless steel.

7. The sprayer according to claim 1, wherein the nozzle has an air path opening to provide a direct path for the air inside the plunger to the one-way valve.

8. The sprayer according to claim 1, wherein the valve has a circular shape with a center opening, wherein the throat runs through the center opening of the valve.

9. The sprayer according to claim 1, including:

a bore coupled to the interior surface of the cap, wherein the bore has a notch; and the plunger has an elongated recess movably coupled to the notch.

10. The sprayer according to claim 1, includes a passage in the interior surface of the cap to allow atmospheric air to enter the interior space of the bore.

11. A reusable mist sprayer for spraying desired liquids, comprising:

a container with a first opening;

a cap with an interior surface;

a plunger movably coupled to the interior surface of the cap, the plunger having a hole and a hollow opening at one end;

a removable dispenser mechanism having a protruding end adapted to receive the hollow opening of the plunger, and a flange adapted to removably seal the first opening;

a plug coupled to the interior surface of the cap and associated with the plug such that the plug blocks the hole as the cap is being pressed relative to the container;

a one-way valve associated with the protruding end of the dispenser mechanism to only allow the air within the interior space of the plunger to enter the container as the cap is being pressed relative to the container; and a means for spraying mist of a combination of liquid and air pressurized within the container.

12. The sprayer according to claim 11, wherein the means for spraying mist of a combination of liquid and air, includes:

a throat movably coupled through the removable dispenser mechanism between a first and second positions, the throat having a port to allow a combination of air and liquid within the container to flow through the port, wherein the port is closed in the first position and the port is open in the second position;

a bias member coupled to the throat, wherein the bias member is predisposed to place the throat in the first position; and a nozzle coupled to the throat, wherein upon application of downward force on the nozzle the throat moves into the second position to allow the combination of air and liquid within the container to flow through the port and flow through the nozzle.

13. The sprayer according to claim 11, wherein the container has double walls with a substantial vacuum gap between the double walls.

14. The sprayer according to claim 11, includes a tube coupled to the means for spraying mist of a combination of liquid and air, and extending into the container.

15. The sprayer according to claim 12, wherein the nozzle has an air path opening to provide a direct path for the air inside the plunger to the one-way valve.

16. A reusable sprayer for spraying mist of liquid contained in the sprayer, comprising:

a container having an interior well and an exterior case with a vacuum sealed gap therebetween with an opening;

a removable dispenser mechanism adapted to seal the opening of the container;

a means for injecting air into the container coupled to the removable dispenser mechanism;

a means for spraying mist of a combination of liquid and air pressurized within the container wherein the means for injecting air into the container includes:

a plunger respectively having a hole and hollow opening at the opposing ends, wherein the hole provides a path for atmospheric air to enter the interior space of the plunger;

a removable dispenser mechanism having a protruding end adapted to receive the hollow opening the plunger, and a flange adapted to removably seal the opening of the container;

a plug associated with the hole such that the plug engages with the hole as the plunger is being pressed relative to the protruding end, and the plug disengages with the hole as the plunger is being pulled relative to the protruding end; and a one-way valve associated with the protruding end, wherein the one-way valve only opens to allow the air within the interior space of the plunger to enter the container as the plunger is being pressed relative to the protruding end.

17. The sprayer according to claim 16, wherein the means for spraying mist of a combination of liquid and air pressurized within the container, includes:

a throat movably coupled through the removable dispenser mechanism between a first and second positions, the throat having a port to allow a combination of air and liquid within the container to flow through the port, wherein the port is closed in the first position and the port is open in the second position;

a bias member coupled to the throat, wherein the bias member is predisposed to place the throat in the first position; and a nozzle coupled to the throat, wherein upon application of downward force on the nozzle the throat moves into the second position to allow the combination of air and liquid within the container to flow through the port and flow through the nozzle.

* * * * *